US009889056B2

(12) United States Patent
Al Bisher

(10) Patent No.: US 9,889,056 B2
(45) Date of Patent: Feb. 13, 2018

(54) INFLATABLE MEDICAL APPARATUS

(71) Applicant: University of Dammam, Dammam (SA)

(72) Inventor: Hassan Mohammed A. Al Bisher, Al Khobar (SA)

(73) Assignee: University of Dammam, Dammam (SA)

( * ) Notice: Subject to any disclaimer, the term of this patent is extended or adjusted under 35 U.S.C. 154(b) by 295 days.

(21) Appl. No.: 14/922,735

(22) Filed: Oct. 26, 2015

(65) Prior Publication Data

US 2017/0112701 A1 Apr. 27, 2017

(51) Int. Cl.
*A61G 13/12* (2006.01)

(52) U.S. Cl.
CPC ..... *A61G 13/1265* (2013.01); *A61G 13/127* (2013.01); *A61G 13/1255* (2013.01)

(58) Field of Classification Search
CPC ..... A61G 13/12
USPC ..... 5/630, 632, 636, 640, 722, 657
See application file for complete search history.

(56) References Cited

U.S. PATENT DOCUMENTS 5,287,577 A * 2/1994 Bremer ..... A61B 6/04 5/601
5,305,750 A 4/1994 Makita
2007/0283496 A1* 12/2007 Skripps ..... A61G 7/05738 5/654

FOREIGN PATENT DOCUMENTS

CN 200991067 Y 12/2007
CN 201154053 Y 11/2008
CN 202802059 U 3/2013

OTHER PUBLICATIONS

Shuai Xue, et al., "Neck dissection with cervical sensory preservation in thyroid cancer", Gland Surgery, http://www.glandsurgery.org/article/view/2973/3881, vol. 2, No. 4, Nov. 2013, 13 pages.

* cited by examiner

*Primary Examiner* — Fredrick Conley
(74) *Attorney, Agent, or Firm* — Oblon, McClelland, Maier & Neustadt, L.L.P.

(57) ABSTRACT

A medical apparatus for extending the neck of a patient without manually lifting the patient. This apparatus has a gel pad assembly encapsulating an inflatable bag connected to two hoses for inflation and deflation purposes. The inflatable bag is positioned beneath the shoulders, thereby lifting the shoulders and hence extending the neck when the inflatable bag is inflated.

20 Claims, 6 Drawing Sheets

INFLATABLE MEDICAL APPARATUS

BACKGROUND OF THE INVENTION

Technical Field

The present invention relates to a medical apparatus, and the method of using this medical apparatus in neck surgeries and recovery from neck surgery. More specifically, the present invention relates to an inflatable medical apparatus with a gel pad assembly that supports the torso of a patient.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Prior to an anterior neck surgery, the patient adopts a supine position with the shoulder supported by a non-inflatable pillow, thereby extending the neck. The procedure to extend the neck is carried out after intubating the patient, and the patient is manually lifted by medical personnel to adjust the pillow to achieve an appropriate position of the neck. Care should be taken to avoid hyperextending the neck. Therefore, these adjustments consume effort and time because they require several attempts before the desired position of the neck is achieved. More importantly, the medical personnel cannot adjust the patient's position during the surgical procedure.

In view of the foregoing, the objective of the present invention is to provide an inflatable medical apparatus to extend a patient's neck without manually lifting the patient. In addition, this medical apparatus provides medical personnel the option of adjusting the patient's neck position during the surgery.

BRIEF SUMMARY OF THE INVENTION

According to a first aspect, the present disclosure relates to a medical apparatus for extending a patient's neck by lifting the patient's shoulder in a surgery upon inflation of an inflatable bag without manually lifting the patient. The components of the medical apparatus are: (1) a gel pad assembly enveloped in a flexible casing, where the gel pad assembly has a top segment and a bottom segment, and a cavity disposed within the gel pad assembly, (2) an inflatable bag encapsulated in the cavity of the gel pad assembly, (3) a first hose for inflating the inflatable bag with a fluid, where the first hose acts as a fluid channel for fluidly connecting an interior of the inflatable bag to an external fluid source, and (4) a second hose for adjusting the pressure of the fluid within the inflatable bag, wherein the second hose acts as a fluid channel for fluidly connecting the interior of the inflatable bag to the ambient atmosphere.

In at least one embodiment, each of a length and breadth of the medical apparatus is 15-80 cm.

In one or more embodiments, the gel pad assembly comprises at least one material selected from the group consisting of silicone, polyacrylamide, and polymacon.

In one or more embodiments, the material of the gel pad assembly can be heated up to 40° C. or cooled to 10-20° C.

In at least one embodiment, a thickness of each of the top and bottom segment of the gel pad assembly is 1-5 cm.

In one or more embodiments, the flexible casing is a polymer film or a fabric.

In one embodiment, the cavity is disposed between the top and bottom segments of the gel pad assembly.

In another embodiment, the cavity is disposed within the top segment of the gel pad assembly.

In at least one embodiment, the cavity is disposed eccentrically.

In at least one embodiment, the inflatable bag has a shape selected from a sphere, cuboid, a cube, a polygonal prism, or a cylinder.

In at least one embodiment, the volume of the inflatable bag when fully inserted is 20-50% relative to the total volume of the medical apparatus.

In one or more embodiments, the inflatable bag has a length that is 50-90% of the breadth of the medical apparatus and the inflatable bag has a breadth that is 10-30% of the length of the medical apparatus.

In at least one embodiment, the inflatable bag has one or more inflatable portions, which can be inflated independently of one another.

In one or more embodiments, the inflatable bag is made of at least one impermeable material selected from the group of rubber, polyvinyl chloride, and polyurethane.

In at least one embodiment, the impermeable material is 0.1-5 mm thick.

In one or more embodiment, the inflatable bag has a longest height of 4-20 cm that can be adjusted during the surgery, where the height is measured along a vertical axis perpendicular to its longitudinal axis.

In at least one embodiment, the first hose and the second hose each have at least one valve to control the flow of the fluid into and out of the inflatable bag.

According to a second aspect, the present disclosure relates to an operating table comprising the medical apparatus of the first aspect, where the medical apparatus is configured to attach to and lie on top of the operating table, and the inflatable bag is positioned under the patient's shoulder so that the inflatable bag lifts the patient's shoulder when inflated to extend the patient's neck while the head of the patient lies on a head ring.

In one embodiment, the gel pad assembly comprises a plurality of straps to secure the medical apparatus to the operating table.

In another embodiment, a bottom of the medical apparatus is releasably attached to a top surface of the operating table with Velcro connectors to secure the medical apparatus to the operating table.

According to a third aspect, the present disclosure relates to a method of positioning a patient during a surgical procedure with the medical apparatus of the first aspect, comprising: (1) attaching the medical apparatus to an operating table, (2) resting a patient's torso on the gel pad assembly, such that the inflatable bag is in contact with the patient's shoulder, (3) inflating the inflatable bag through the first hose to lift the patient's shoulder, and (4) adjusting pressure within the inflatable bag through the second hose to adjust an exposure of the patient's neck.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1A:
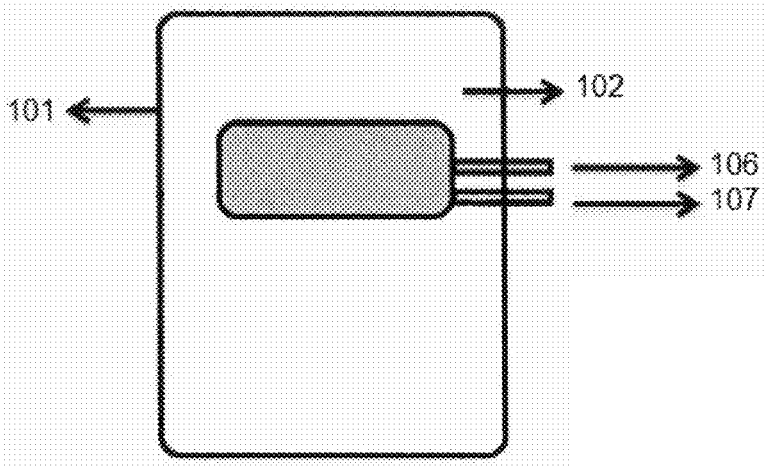
FIG. 1A shows the top view of a preferred embodiment of the medical apparatus.
Figure 1B:
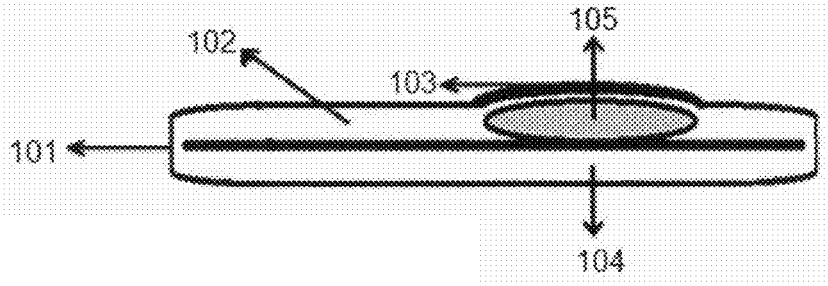
FIG. 1B shows the side view of the embodiment of FIG. 1A, before inflating the inflatable bag.
Figure 1C:
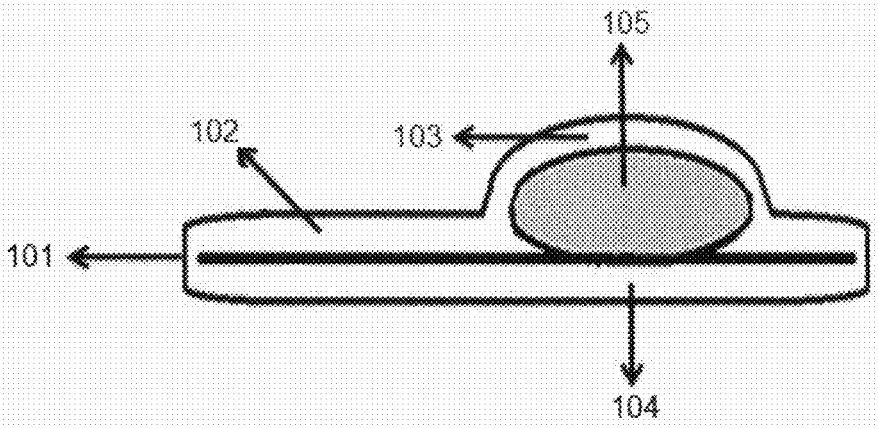
FIG. 1C shows the side view of the embodiment of FIG. 1A, after inflating the inflatable bag.
Figure 2:
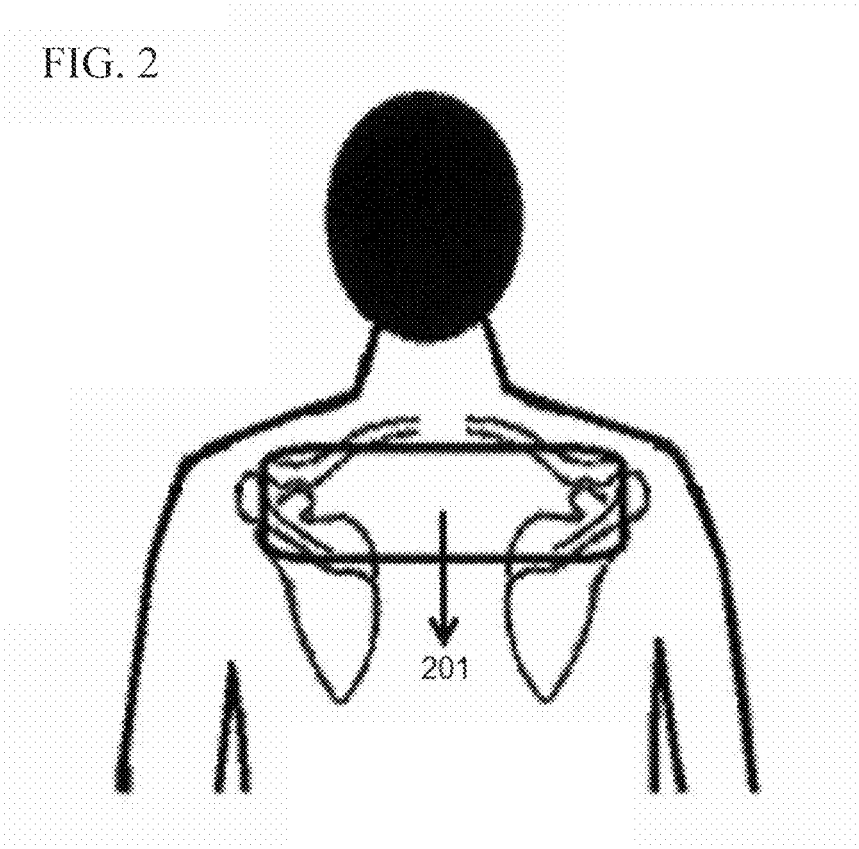
FIG. 2 highlights the region where the inflatable bag should be positioned.
Figure 3A:
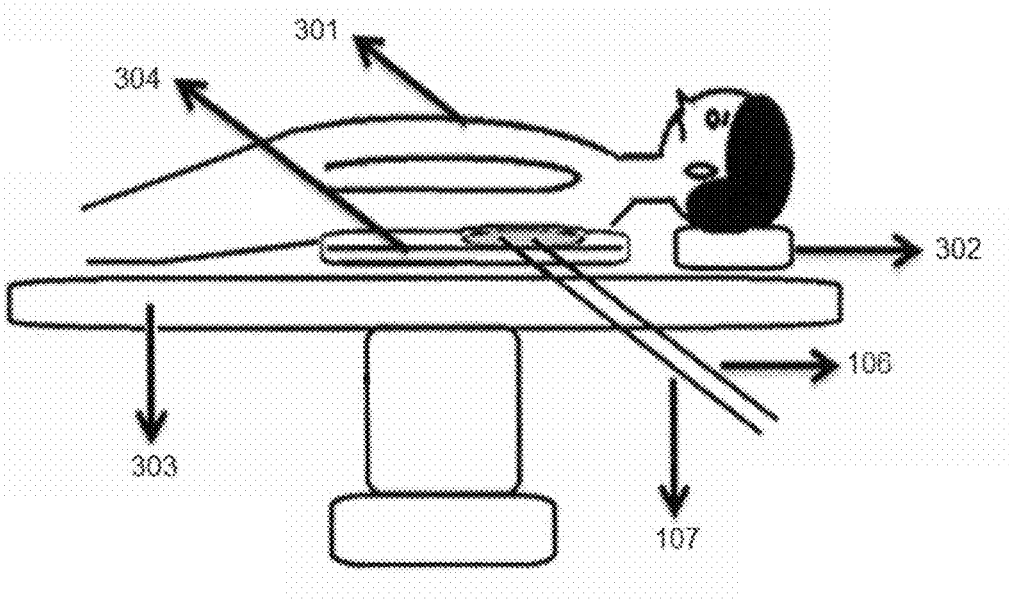
FIG. 3A shows the side view of a patient lying on the medical apparatus attached to an operating table, before inflating the inflatable bag.
Figure 3B:
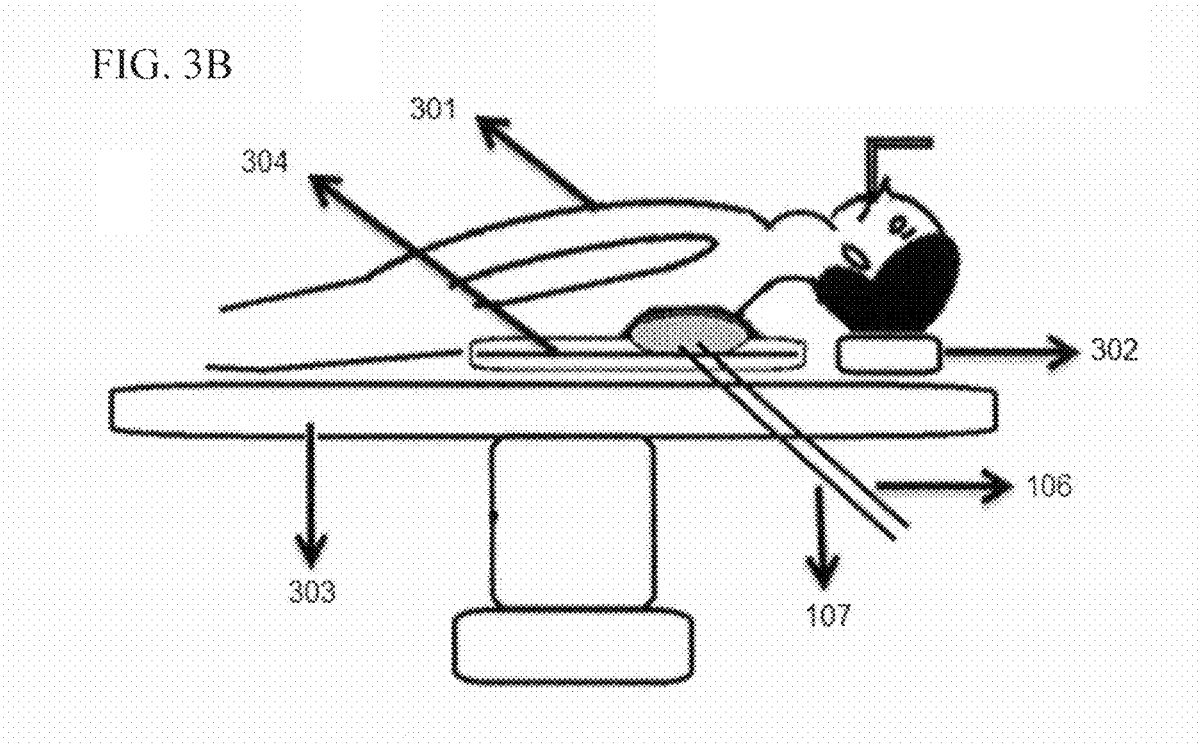
FIG. 3B shows the side view of a patient lying on the medical apparatus attached to an operating table, after inflating the inflatable bag.

Embodiments of the present disclosure will now be described more fully hereinafter with reference to the accompanying drawings, in which some, but not all embodiments of the disclosure are shown. Referring now to the drawings, wherein like reference numerals designate identical or corresponding parts throughout the several views.

The present disclosure relates to a medical apparatus for extending a patient's neck by lifting the patient's shoulder in a surgery upon inflation of an inflatable bag without manually lifting the patient. In addition, the height of inflation can be easily adjusted during the surgery. In a preferred embodiment, the medical apparatus is employed in thyroid surgery, parathyroid surgery, tracheal surgery, and cervical lymph node dissection. In addition to these exemplary surgical procedures, other types of surgical and non-surgical procedures may also be performed using the medical apparatus of the present disclosure, in one or more of its embodiments.

The components of the medical apparatus are: (1) a gel pad assembly enveloped in a flexible casing 101, where the gel pad assembly has a top segment 102 and a bottom segment 104, and a cavity disposed within the gel pad assembly, (2) an inflatable bag 105 encapsulated in the cavity of the gel pad assembly, (3) a first hose 106 for inflating the inflatable bag with a fluid, where the first hose acts as a fluid channel for fluidly connecting an interior of the inflatable bag to an external fluid source, and (4) a second hose 107 for adjusting the pressure within the inflatable bag, where the second hose acts as a fluid channel for fluidly connecting the interior of the inflatable bag to the ambient atmosphere. The term "fluid", as used herein, refers to a substance, which can be a liquid or gas, that is capable of flowing and has the tendency to assume the shape of its container.

The medical apparatus is designed to come in various sizes to support children, adolescents, and adults. The medical apparatus can accommodate patients weighing up to 200 kg. A shape of the medical apparatus includes, but is not limited to, a circle, an oval, an ellipse, and a polygon such as triangle, square, pentagon, and hexagon. In a preferred embodiment, the medical apparatus has a rectangular shape. In one embodiment, a length and a breadth of the medical apparatus is 15-80 cm respectively, preferably 30-80 cm, more preferably 50-80 cm. In another embodiment, the medical apparatus has a length extending from the cervical vertebrae to the apex of the ilium, and a width is preferably no less than the distance between the rotator cuffs of the shoulders.

The gel pad assembly is enveloped in a flexible and resilient casing, which can be a polymer film or a fabric. Examples of the polymer film include, but are not limited to, polyurethane, polypropylene, polyester, polyether, and silicone urethane copolymer. In a preferred embodiment, the casing is a film of polyvinyl chloride. In one embodiment, the thickness of the film ranges from 0.1-2 mm, preferably 0.1-1.5 mm, more preferably 0.1-1 mm. Examples of the fabric include, but are not limited to, woven fabric, knitted fabric, and mesh fabric. Materials for the fabric include, but are not limited to, nylon, polyester, and preferably, cotton. The casing may have an inner surface laminated with a layer of urethane that has a thickness of approximately 0.01-0.1 mm, more preferably 0.04-0.1 mm, more preferably 0.08-0.1 mm. The casing may also have a coat of urethane on its outer surface to a thickness that may be in the range of 1-20 mm, preferably 3-15 mm, more preferably 6-12 mm. The coat of urethane on the outer surfaces provides a fluid repellency to the medical apparatus to repel blood, sweat, or other fluids that may be generated during the medical procedure.

In one embodiment, the flexible casing is made from one continuous piece of polymer film or a fabric, and is sealed on three sides by fluid-tight seams. In another embodiment, the flexible casing is made from two pieces of polymer film or a fabric, where each piece may have the same dimensions, and is sealed on all sides by fluid-tight seams. In another embodiment, the flexible casing has a zipper on at least one side of the casing for easy removal of the gel pad assembly from within flexible casing.

The gel pad assembly provides a soft and comfortable support and distributes the weight of the patient's back over the entire contact surface area. In one embodiment, the gel pad assembly is made of at least one of polyacrylamides, polymacon, polyurethane, rubber, and preferably silicone.

In a preferred embodiment, the gel pad assembly is used under room temperature conditions. It is envisioned that there are situations where a cooled gel pad assembly can be advantageous. When the surgery needs to be done at temperatures below room temperature to slow down the body's metabolism and hence minimize the damage/risk to organs and brain (S A Bernard, T W Gray, M D Buist, B M Jones, W Silvester, G Gutteridge, K Smith New England Journal of Medicine 346 (8): 557-563, 2002—incorporated herein by reference in its entirety), the gel pad assembly can be cooled to 10-20° C., preferably 10-18° C., more preferably 12-18° C. by a thermostated cold water bath or a refrigerator prior to the surgery. In another embodiment, the top segment of the gel pad consists of serpentine channel of cooling fluid extended throughout the top segment. A first end of the serpentine channel is fluidly connected to an outlet of a bath circulator, and a second end of the serpentine channel is fluidly connected to an inlet of the bath circulator. Coolants, such as chilled normal saline solution or water, may be used to provide the cooling effect. In one embodiment, the temperature of the coolant is held between 10-20° C., preferably 10-18° C., more preferably 12-18° C.

In an alternative embodiment, when the patient is experiencing hypothermia or a surgical procedure should advantageously be performed at temperatures above room temperature, a heated gel pad assembly could be used. The material of the gel pad assembly can be heated up to 40° C., preferably 30-37° C., more preferably 32-36° C. by a thermostated heated water bath or a microwave prior to the surgery. In another embodiment, where the top segment consists of the aforementioned serpentine fluid channel, the gel pad can be heated by circulating warm water from a heated bath circulator. In one embodiment, the temperature of the circulating fluid is held between 30-40° C., preferably 30-37° C., more preferably 32-36° C.

In one embodiment, the thickness of the top and bottom segments of the gel pad assembly is 1-5 cm respectively, preferably 1-4 cm, more preferably 1-3 cm. In a preferred embodiment, the top and bottom segments have a uniform thickness throughout the length of the gel pad. For example, the thickness of the top segment may be 2 cm at any point along the length of the gel pad, and the thickness of the bottom segment may be 2 cm at any point along the length of the gel pad. In another embodiment, the thickness of the top segment may be 2 cm at any point along the length of the gel pad, and the thickness of the bottom segment may be 4 cm. In some embodiments, a portion of the top segment, region 103, covering a top surface of the cavity is 0.1-4 cm thicker than bottom segment, preferably 0.1-3 cm, more preferably 0.1-2 cm. The thicker gel pad covering the cavity provides a more comfortable support.

In a preferred embodiment, the top and bottom segments are made from the same material. In another embodiment, the top segment is made of a gel-like material, and the bottom segment is a plastic foam made from polyurethane, polyvinyl chloride, polystyrene, or polyimide, or a block of plastic made from polycarbonate, polypropylene, polythene, acrylic, epoxy, or melamine.

In one embodiment, the cavity is disposed between the top and bottom segments of the gel pad assembly. In a preferred embodiment, the cavity is disposed within the top segment of the gel pad assembly. In one embodiment, the cavity is disposed eccentrically along the length of the medical apparatus. The center of the cavity is offset by 5-45% of the length of the medical apparatus from the center of the medical apparatus, preferably 15-45%, more preferably 30-45%. In another embodiment, the cavity is disposed eccentrically along the height of the gel pad assembly. The center of the cavity is offset by 5-45% of the height of the medical apparatus from the center of the medical apparatus, preferably 15-45%, more preferably 30-45%.

The shape of the inflatable bag may include, but is not limited to, a sphere, a cuboid, a cube, a polygonal prism, or a cylinder. In a preferred embodiment, the inflatable bag is an ellipsoid. In another embodiment, the inflatable bag is a rectangular prism.

In one embodiment, the inflatable bag has a length that is 50-90% of the breadth of the medical apparatus, preferably 60-90%, more preferably 80-90%. The inflatable bag has a breadth that is 10-30% of the length of the medical apparatus, preferably 15-30%, more preferably 15-20%. In another embodiment, the inflatable bag has a length preferably no less than the distance between the rotator cuffs of the shoulders, and a width is preferably no less than the distance between the acromion and the bottom of the shoulder blade.

The inflated bag has a height of 4-20 cm that can be adjusted during the surgery, preferably 5-15 cm, more preferably 5-12 cm. The volume of the inflatable bag when inflated is 20-50% relative to the total volume of the medical apparatus, preferably 25-45%, more preferably 30-40%. In a preferred embodiment, the inflatable bag is oriented with its longitudinal axis perpendicular to the longitudinal axis of the medical apparatus. In another embodiment, the inflatable bag is oriented with its longitudinal axis parallel to the longitudinal axis of the medical apparatus.

In one embodiment, the inflatable bag is made of at least one impermeable material, which is rubber, polyvinyl chloride, and preferably polyurethane. The impermeable material of the inflatable bag is 0.1-5 mm thick, preferably 0.1-2 mm, more preferably 0.1-1 mm.

The first and second hoses are fluidly connected to the inflatable bag to control the inflation of the inflatable bag. The first hose acts as a fluid channel for fluidly connecting an interior of the inflatable bag to an external fluid source, with a first end of the first hose connected to the inflatable bag, and a second end of the first hose fluidly connected to the external fluid source. The second hose adjusts the pressure of the fluid within the inflatable bag by releasing an appropriate amount of fluid in the inflatable bag to the ambient atmosphere. The first end of the second hose connected to the inflatable bag and a second end of the second hose exposed to the ambient atmosphere. In one embodiment, there is at least one valve on each of the first and second hoses to control the flow of the fluid into and out of the inflatable bag. In a preferred embodiment, these valves are one-way valves. The one-way valve on the first hose permits fluid to flow from the external fluid source to the inflatable bag and prevents a return flow of fluid from the inflatable bag to the external fluid source. The one-way valve on the second hose permits fluid to flow from the inflatable bag to the ambient atmosphere and prevents a flow of fluid from the ambient atmosphere to the inflatable bag.

In one embodiment, the first and second hoses extend from a bottom of the medical apparatus. The first ends of the first and second hoses thread through pre-formed holes on a bottom of the flexible casing and conduits in the bottom segment of the gel pad assembly to connect with the inflatable bag. In another embodiment, the first and second hoses extend from a side of the medical apparatus. The first ends of the first and second hoses thread through pre-formed holes on a side of the flexible casing and conduits in a side of the gel pad assembly to connect with the inflatable bag.

In at least one embodiment, the first ends of the first and second hoses are integrated with the bag. In one embodiment, the first end of the first hose extends to the inside of the inflatable bag and connects to an interior wall opposite of the entry point, and a portion of the first hose connected to the interior wall have a plurality of small apertures that release the fluid to the inside of the bag. In another embodiment, the inflatable bag has two hose adapters that are integrated with the bag, and the first end of the first hose is connected to the first hose adapter, and the first end of the second hose is connected to the second hose adapter.

In one embodiment, the outer diameters of the first and second hoses are 1-20 mm, preferably 5-15 mm, more preferably 10-15 mm. The thicknesses of the first and second hoses are 1-5 mm, preferably 1-3 mm.

The first and second hose may each independently be made of one or more types of material, including but not limited to polyurethane, nylon, polyethylene, polyvinyl chloride, and polytetrafluoroethylene.

In one embodiment, the fluid is water, and the external fluid source is a faucet. In a preferred embodiment, the fluid is air. In one embodiment, the external fluid source is an electrical pump, which is programmable and may regulate the pressure within the inflatable bag automatically. In a preferred embodiment, the external fluid source is a hand grip type air pump. In another embodiment, the external fluid source is a supply of compressed air. The second end of the first hose has a quick connect/disconnect fitting for connection to the supply of compressed gas, such as the types of fittings used for connecting a facial mask to a supply of nitrous oxide or oxygen.

In a preferred embodiment, the inflatable bag has one inflatable portion (i.e. the bag as a whole provides one inflatable portion). In one embodiment, the inflatable bag has a plurality of inflatable portions, which can be inflated independently of one another and are separated by fluid-tight seams and/or dividers. Each inflatable portion has a first tube and a second tube with their first ends connected to the inflatable portion and their second ends fluidly connected to the first ends of the first and second hoses respectively. In an embodiment, the second ends of the first tubes connect to a first valve unit, which is connected to the first end of the first hose. The second ends of the second tubes connect to a second valve unit, which is connected to the first end of the second hose. The first valve unit regulates the fluid flow into the inflatable portions through the first tubes and has a structure to allow the fluid to flow into only one of the inflatable portions. The inflatable portions can inflate at different pressures, and/or in a particular sequence. The second valve unit prevents the air in the inflatable portions from flowing out. In one embodiment, each inflatable portion can hold the same volume of fluid at maximum capacity. In one embodiment, the portion of the top segment covering the plurality of inflatable portions could have different thicknesses in one or more portions corresponding with separate inflatable portions.

In surgeries involving the side of the neck, it would be advantageous to tilt the patient to expose the site of interest. In one embodiment, the inflatable bag has two inflatable portions, which have the same volume and are arranged adjacent to each other along the horizontal axis of the medical apparatus. Each inflatable portion can be inflated to a different extent, thereby tilting the patient at angles 1-30°, preferably 5-25°, more preferably 5-15° relative to the horizontal plane. For example, if the left side of the neck needs to be operated on, the inflatable portion beneath the left shoulder will be more inflated than the inflatable portion beneath the right shoulder.

The present disclosure also relates to an operating table comprising the medical apparatus 304. In at least one embodiment, the medical apparatus is configured to attach to and lie on top of the operating table 303, with the inflatable bag positioned under the patient's shoulder 201 so that the inflatable bag lifts the patient's shoulder when inflated to extend the patient's neck, and the patient's head is rested on a head ring 302.

The gel pad assembly may be releasably attached to the operating table. In one embodiment, the gel pad assembly comprises a plurality of straps along a first side of the medical apparatus that is parallel to the longitudinal axis of the medical apparatus and a plurality of straps along a second side of the medical apparatus that is opposite to the first side of the medical apparatus to secure the medical apparatus to the operating table. In one embodiment, the straps are equally spaced. The straps may be made of the aforementioned fabrics, and have a length that is at least as long as a breadth of the operating table. First ends of the straps may be sewn to the flexible casing, and second ends of the straps on the first side of the medical apparatus are connected to second ends of the straps on the second side of the medical apparatus below the operating table. The second ends of the straps may be connected by tying, buckling, Velcro connectors, hooks, safety pins, or snap buttons. In one embodiment, the straps are oriented perpendicular to the longitudinal axis of the medical apparatus.

In another embodiment, there is a plurality of straps along a first side of the medical apparatus that is parallel to the longitudinal axis of the medical apparatus. Second ends of the straps are each connected to a hook, snap button, buckle, or Velcro connector, and the straps go under the operating table to connect with a second side of the medical apparatus that is opposite to the first side of the medical apparatus. The second side of the medical apparatus is connected to hooks, snap buttons, buckles, or Velcro connectors to connect to the second ends of the straps.

In another embodiment, the bottom of the medical apparatus is attached to a top surface of the operating table with Velcro connectors. The Velcro connectors are placed along the perimeter of the medical apparatus. In another embodiment, the Velcro connectors are placed along a centrally disposed longitudinal axis of the medical apparatus and along a centrally disposed horizontal axis of the medical apparatus.

In another embodiment, the bottom of the medical apparatus is integrated with a hard flat sheet, which provides a stable base for manipulating the pillow and/or patient. A bottom of the flat sheet lies on the operating table. The sheet may be made of a hard plastic such as polycarbonate, polyurethane, polyester, epoxy and phenolic resin. The sheet may take on the same aforementioned shape as the medical apparatus. A length and breadth of the sheet are as long as the length and breadth of the medical apparatus. A thickness of the sheet is 1-5 cm, preferably 1-4 cm, more preferably 1.5-3 cm. In one embodiment, the medical apparatus is attached to the operating table with a plurality of spring loaded latches. A plurality of latch strikes are screwed into a first side of the flat sheet that is parallel to the longitudinal axis of the medical apparatus, and a plurality of toggle latches are screwed into a first side of the operating table. The first sides of the flat sheet and the operating table lie in the same vertical plane. The aforementioned arrangement of a plurality of latch strikes is repeated on a second side of the flat sheet that is opposite to the first side of the flat sheet, and the aforementioned arrangement of a plurality of toggle latches is repeated on a second side of the operating table that is opposite to the first side of the operating table. In one embodiment, the latch strikes and the toggle latches are spaced equally on the first sides of the flat sheet and the operating table respectively.

The present disclosure also relates to a method of positioning a patient during a surgical procedure with the medical apparatus. Prior to using the medical apparatus, it is advantageous to visually inspect the medical apparatus for holes and tears, check for leaks, and the condition of the hoses. The method of positioning the patient 301 comprises: (1) attaching the medical apparatus to an operating table, (2) resting a patient's torso on the gel pad assembly, such that the inflatable bag is beneath the patient's shoulder, (3) inflating the inflatable bag through the first hose to lift the patient's shoulder, and (4) adjusting pressure within the inflatable bag through the second hose to adjust an exposure of the patient's neck.

In at least one embodiment, the inflatable bag is over-inflated slightly. Then, the first valve on the first hose is adjusted to stop the fluid flow. The medical personnel slightly opens the second valve on the second hose to permit a controlled escape of fluid from the inflatable bag. The second valve is closed when the proper degree of inflation is achieved. When the procedure done, the inflatable bag is deflated and the medical device removed after extubating the patient.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A medical apparatus, comprising:

a gel pad assembly enveloped in a flexible casing, wherein the gel pad assembly has a top segment and a bottom segment, and a cavity disposed within the gel pad assembly;

an inflatable bag encapsulated in the cavity of the gel pad assembly;

a first hose for inflating the inflatable bag with a fluid, wherein the first hose acts as a fluid channel for fluidly connecting an interior of the inflatable bag to an external fluid source; and a second hose for adjusting the pressure of the fluid within the inflatable bag, wherein the second hose acts as a fluid channel for fluidly connecting the interior of the inflatable bag to the ambient atmosphere;

wherein the medical apparatus extends a patient's neck by lifting the patient's shoulder in a surgery upon inflation of the inflatable bag without manually lifting the patient.

2. The medical apparatus of claim 1, wherein each of a length and breadth of the medical apparatus is 15-80 cm.

3. The medical apparatus of claim 1, wherein the gel pad assembly comprises at least one material selected from the group consisting of silicone, polyacrylamide, and polymacon.

4. The medical apparatus of claim 3, wherein the material of the gel pad assembly can be heated up to 40° C. or cooled to 10-20° C.

5. The medical apparatus of claim 1, wherein a thickness of each of the top and bottom segment of the gel pad assembly is 1-5 cm.

6. The medical apparatus of claim 1, wherein the flexible casing is a polymer film or a fabric.

7. The medical apparatus of claim 1, wherein the cavity is disposed between the top and bottom segments or within the top segment of the gel pad assembly.

8. The medical apparatus of claim 1, wherein the cavity is disposed eccentrically.

9. The medical apparatus of claim 1, wherein the inflatable bag has a shape selected from a sphere, cuboid, a cube, a polygonal prism, or a cylinder.

10. The medical apparatus of claim 1, wherein the volume of the inflatable bag when fully inflated is 20-50% relative to the total volume of the medical apparatus.

11. The medical apparatus of claim 1, wherein the inflatable bag has a length that is 50-90% of the breadth of the medical apparatus and the inflatable bag has a breadth that is 10-30% of the length of the medical apparatus.

12. The medical apparatus of claim 1, wherein the inflatable bag has one or more inflatable portions, which can be inflated independently of one another.

13. The medical apparatus of claim 1, wherein the inflatable bag is made of at least one impermeable material selected from the group consisting of rubber, polyvinylchloride, and polyurethane.

14. The medical apparatus of claim 13, wherein the impermeable material is 0.1-5 mm thick.

15. The medical apparatus of claim 1, wherein the inflatable bag has a longest height of 4-20 cm that can be adjusted during the surgery, where the height is measured along a vertical axis perpendicular to a longitudinal axis of the inflatable bag.

16. The medical apparatus of claim 1, wherein the first hose and the second hose each have at least one valve to control the flow of the fluid into and out of the inflatable bag.

17. An operating table comprising the medical apparatus of claim 1, wherein the medical apparatus is configured to attach to and lie on top of the operating table, and the inflatable bag is positioned under the patient's shoulder so that the inflatable bag lifts the patient's shoulder when inflated to extend the patient's neck.

18. The operating table of claim 17, wherein the gel pad assembly comprises a plurality of straps, wherein the straps secure the medical apparatus to the operating table.

19. The operating table of claim 17, wherein a bottom of the medical apparatus is releasably attached to a top surface of the operating table with Velcro connectors to secure the medical apparatus to the operating table.

20. A method of positioning a patient during a surgical procedure with the medical apparatus of claim 1, comprising:

attaching the medical apparatus to an operating table;

resting a patient's torso on the gel pad assembly, such that the inflatable bag is in contact with the patient's shoulder;

inflating the inflatable bag through the first hose to lift the patient's shoulder; and adjusting pressure within the inflatable bag through the second hose to adjust an exposure of the patient's neck.

* * * * *